US008591388B2

(12) United States Patent
Jahns

(10) Patent No.: US 8,591,388 B2
(45) Date of Patent: Nov. 26, 2013

(54) COMPACT AND LIGHT MULTI-EXERCISE DEVICE PROVIDING HYPEREXTENSION AND INSTABILITY IN ALL DIRECTIONS

(76) Inventor: Henner Jahns, Los Angeles, CA (US)

( * ) Notice: Subject to any disclaimer, the term of this patent is extended or adjusted under 35 U.S.C. 154(b) by 437 days.

(21) Appl. No.: 12/901,550

(22) Filed: Oct. 10, 2010

(65) Prior Publication Data

US 2011/0028289 A1 Feb. 3, 2011

Related U.S. Application Data

(63) Continuation-in-part of application No. 12/291,966, filed on Nov. 14, 2008, now abandoned.

(60) Provisional application No. 61/003,303, filed on Nov. 16, 2007.

(51) Int. Cl.
*A63B 71/00* (2006.01)
*A63B 23/08* (2006.01)
*A63B 23/10* (2006.01)

(52) U.S. Cl.
USPC ..... 482/140; 482/79; 482/141

(58) Field of Classification Search
USPC ..... 482/51–53, 55, 74, 77, 79, 91, 482/111–112, 121–123, 140–142, 146–148, 482/131–132, 139; 128/845; 434/247, 255; D21/662, 685–689
See application file for complete search history.

(56) References Cited

U.S. PATENT DOCUMENTS

| | | | | | |
|---|---|---|---|---|---|
| 1,497,243 | A * | 6/1924 | Martin | 606/237 |
| 3,102,280 | A * | 9/1963 | Williams | 441/130 |
| 3,862,768 | A * | 1/1975 | England | 280/205 |
| 3,895,794 | A * | 7/1975 | England | 482/146 |
| 3,968,820 | A * | 7/1976 | Kolb et al. | 141/330 |
| 5,566,682 | A * | 10/1996 | Yavitz | 5/630 |
| 6,447,429 | B1 * | 9/2002 | Chen et al. | 482/79 |

* cited by examiner

*Primary Examiner* — Oren Ginsberg
(74) *Attorney, Agent, or Firm* — Aaron P. McGushion

(57) ABSTRACT

The exercise device of the present invention includes a convex dome on a bottom surface and an arched ridge on the top surface with troughs formed on both sides of the arched ridge. In a first configuration, the bottom surface faces downward where the convex dome rests on the floor and the exerciser is provided an unstable exercise platform. In a second configuration, the top surface and arched ridge face downward where the ends of the exercise device are resting on the floor and the exerciser is provided a stable exercise platform.

7 Claims, 9 Drawing Sheets

COMPACT AND LIGHT MULTI-EXERCISE DEVICE PROVIDING HYPEREXTENSION AND INSTABILITY IN ALL DIRECTIONS

CROSS-REFERENCE TO RELATED APPLICATIONS

This application is a continuation-in-part of application Ser. No. 12/291,966 filed Nov. 14, 2008 now abandoned entitled "Compact and Light Multi-Exercise Device Providing Hyperextension and Instability in all Directions," which claims the benefit of U.S. Provisional Patent Application 61/003,303 filing date Nov. 16, 2007.

BACKGROUND OF THE INVENTION

1. Field of Invention

The present invention relates to an exercise device, and more specifically to increasing the effectiveness of abdominal muscle exercises by selectively providing a stable or non-stable platform.

2. Description of the Related Art

Exercise devices that provide a platform for supporting the body in exercising various muscle groups have had the ability to produce instability through the use of a curved or domed surface, to provide instability in one direction or in all directions.

For example, U.S. Pat. No. 1,497,243 to Martin provides a foot exerciser with a rocker bottom on one side and, on the opposite side, two concave foot supporting surfaces divided by a ridge. The user places his feet within the concave foot supporting surfaces; and the feet are separated by the ridge. From that position, the device provides an unstable platform to exercise the feet and lower legs. However, Martin's device cannot be transitioned into a stable exercise platform and cannot be used to exercise other muscle groups, due to its inherent design limitations and teachings.

What is needed and not yet provided in the art, is an exercise device that can exercise upper body, lower body, and abdominal muscle groups, while selectively providing a stable and unstable exercise platform.

SUMMARY OF THE INVENTION

The present invention provides a compact exercise apparatus that provides numerous exercise options, makes exercising easy and fun, and is highly effective by providing hyperextension in conjunction with selective stability or instability. The invention could be used to do sit-ups, crunches, and lateral crunches muscles of the arm, upper and lower abdominal muscles, lower back, oblique muscles on the side of the core could be targeted for conditioning. These exercises will sculpt the waist, lower back, buttocks, and sides.

The exercise device of the present invention includes a top surface opposite a bottom surface, a first end opposite a second end, a first side opposite a second side, a convex dome on the bottom surface, and an arched ridge on the top surface for supporting directly thereon a portion of an exerciser's body in at least one exercise configuration. The first end is preferably parallel to the second end in at least one plane to enhance stability in a second configuration. The arched ridge on the top surface preferably extends from the first side to the second side and has an arch curvature that is substantially constant along the length of the arched ridge. Between the arched ridge and the first end a first trough is formed; and between the arched ridge and the second end a second trough is formed.

There are at least two exercise configurations, a first configuration and a second configuration. In the first configuration the exercise device is configured to provide an unstable exercise platform by positioning the bottom surface downward with the convex dome contacting a support surface. In the second configuration the exercise device is configured to provide a stable exercise platform by positioning the top surface downward with both the first end and the second end contacting the support surface.

Figure 1:
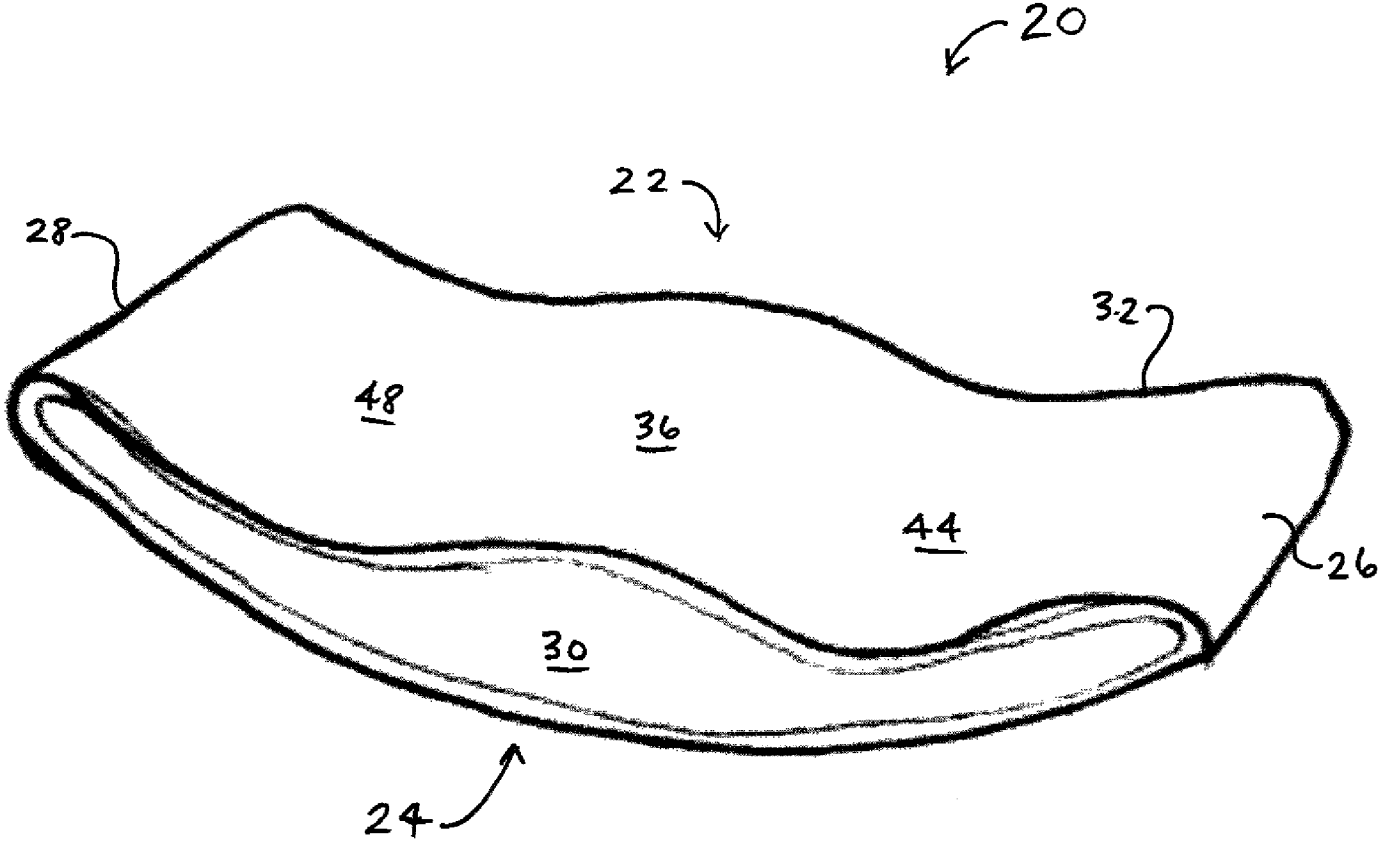
FIG. 1 shows a perspective view of the present invention.

LISTING OF REFERENCE NUMERALS of FIRST-PREFERRED EMBODIMENT exercise device 20
top surface 22
bottom surface 24
first end 26
second end 28
first side 30
second side 32
convex dome 34
arched ridge 36
arch curvature 40
surface 42
first trough 44
second trough 48
support surface 52
lower back 58
foot arch 60
exerciser 62

DESCRIPTION OF THE PREFERRED EMBODIMENTS

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Looking first at FIG. 1, the top surface 22 of the exercise device 20 can be seen, having formed thereon an arched ridge 36 that extends from the first side 30 to the second side 32. The length of the arched ridge 36 is generally measured from the first side 30 to the second side 32. The preferred curvature of the arched ridge 36 can be seen from the first side 30. This curvature is preferably constant along the entire length of the arched ridge to provide consistent support to the middle or lower back or other portion of an exerciser's body. On each side of the centrally located arched ridge 36 is a trough, a first trough 44 and a second trough 48. The troughs 44 and 48 are configured to selectively support a portion of the exerciser's body, such as the buttocks or upper back. The first end 26 and the second end 28 are contoured to enable an exerciser to grip the ends comfortably with her hands.

Figure 2:
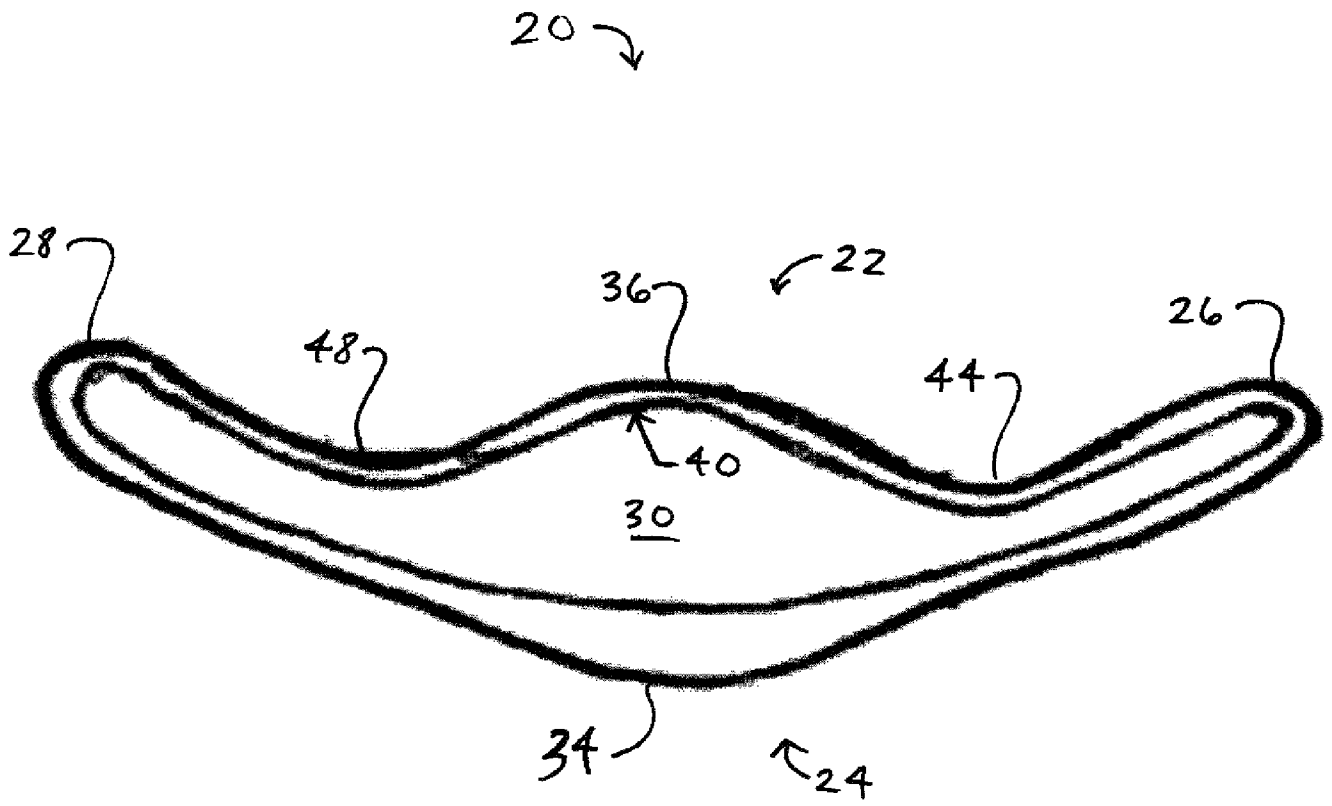
FIG. 2 shows a side view of the present invention.

FIG. 2 more clearly shows the overall shape of the present invention from the viewpoint of the first side 30. The convex dome 34 is formed on the bottom surface 24. Because the convex dome 34 has a dome-like shape, when the exercise device 20 is placed on a supporting surface, it will be instable in all directions. This means the exerciser must exert an effort in order to maintain a stable motion, such as rocking without tipping, and will thus receive a more intense and thorough exercise.

Figure 3:
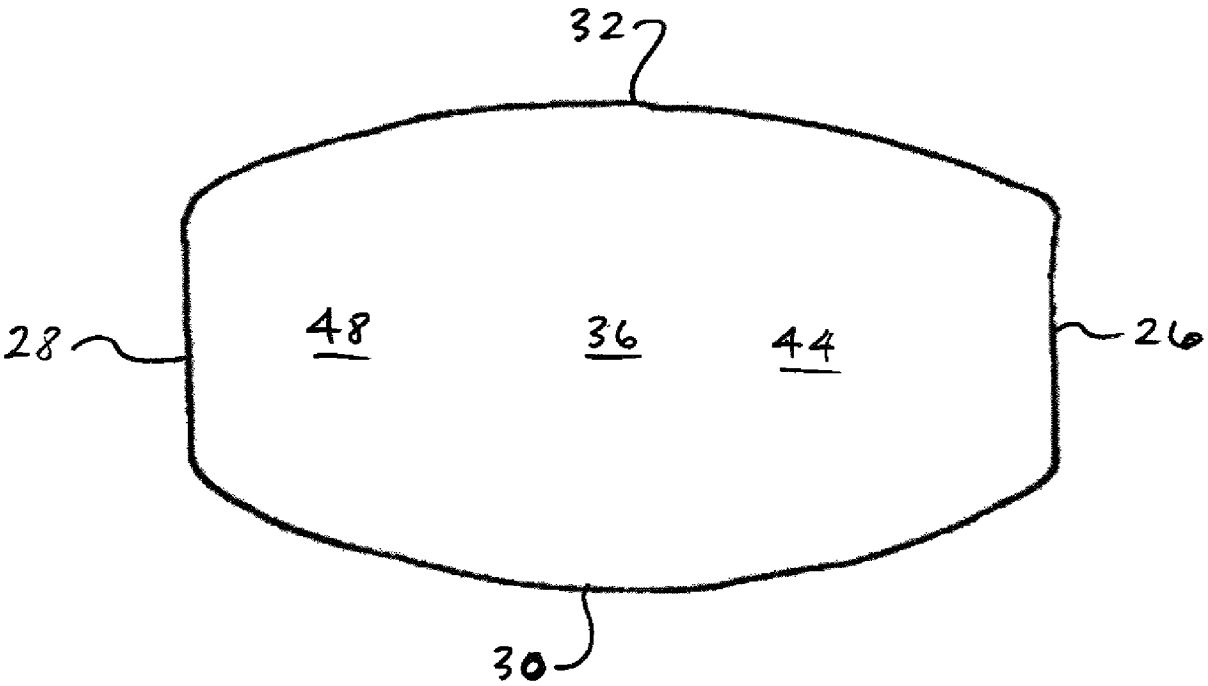
FIG. 3 shows a top view of the present invention.
Figure 4:
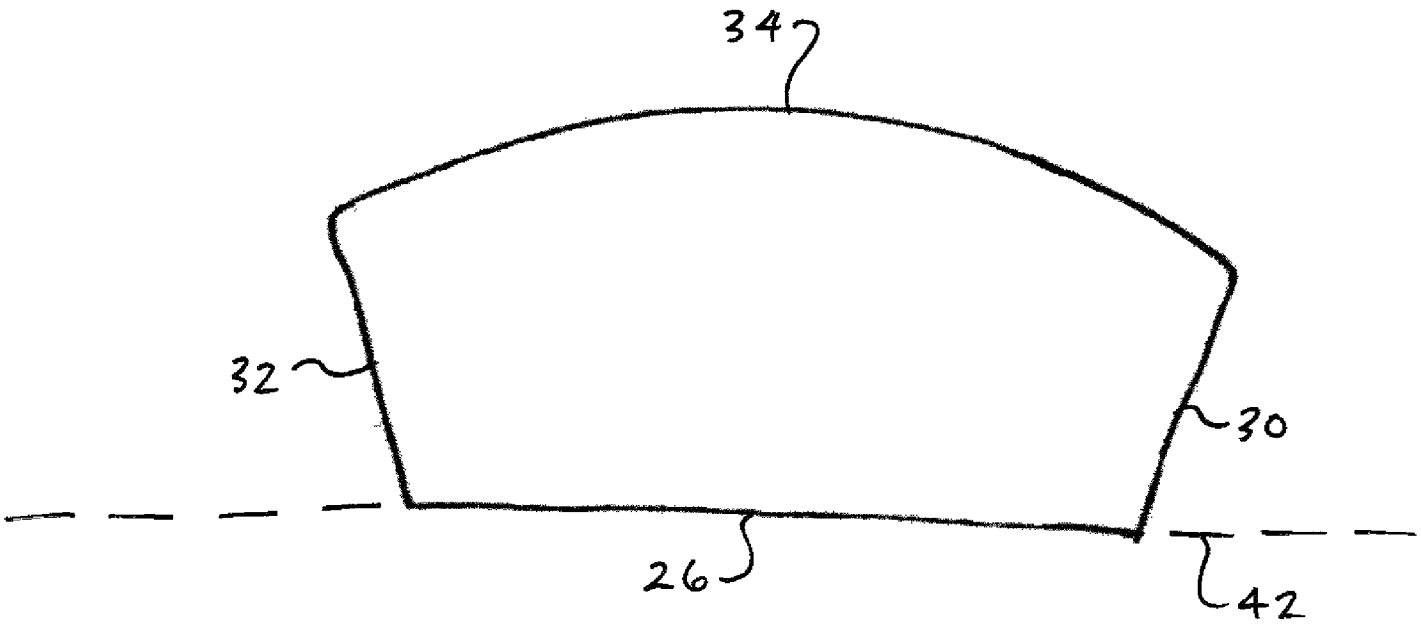
FIG. 4 shows an end view of the present invention.

FIGS. 3 and 4 show a top and end view of the present invention, further illustrating the basic shape. In FIG. 3, the exercise device 20 is shown inverted in the second configuration where the first end 26 and second end 28 (not visible) are supported by a surface 42, such as a floor or mat. The first end 26 and second end 28 are arranged such that they contact the surface 42 in one plane and thereby provide a stable exercise platform where the exercise device 20 will not rock in any direction. In other words, at least a portion of the first end 26 is parallel to another portion of the second end 28, so that both ends 26 and 28 contact the surface simultaneously and provide stability.

Figure 5:
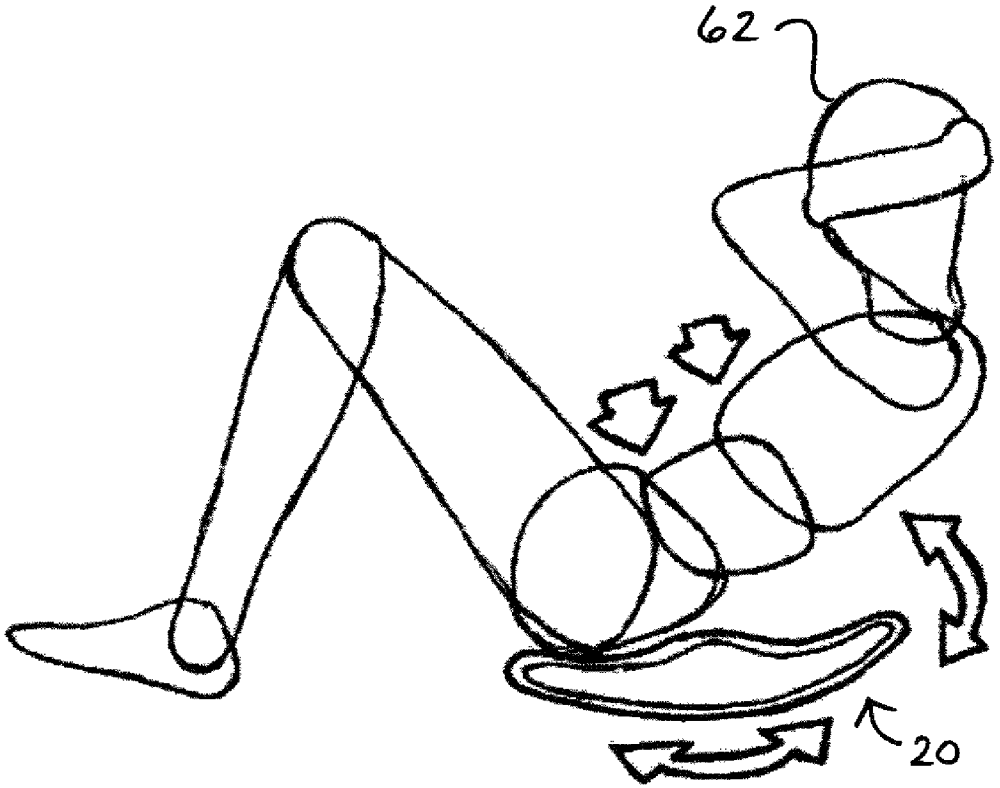
FIG. 5 shows an exerciser using the present invention for crunches, with the invention in the first configuration.

FIG. 5 shows an exerciser 62 performing a crunch exercise, where the exercise device is in the first configuration and the convex dome 34 is contacting the floor beneath. The buttocks of the exerciser 62 are supported within the second trough 48 and the lower back is supported over the arched ridge 36. The curved arrows show the ability of the exercise device 20 to provide instability in multiple directions, twisting and rocking in this example. The straight arrows show the major muscle groups being exercised. Further, because of the instability of the first configuration, the exerciser 62 must use her legs to enhance stability, thus providing an additional leg and abdominal workout.

Figure 6:
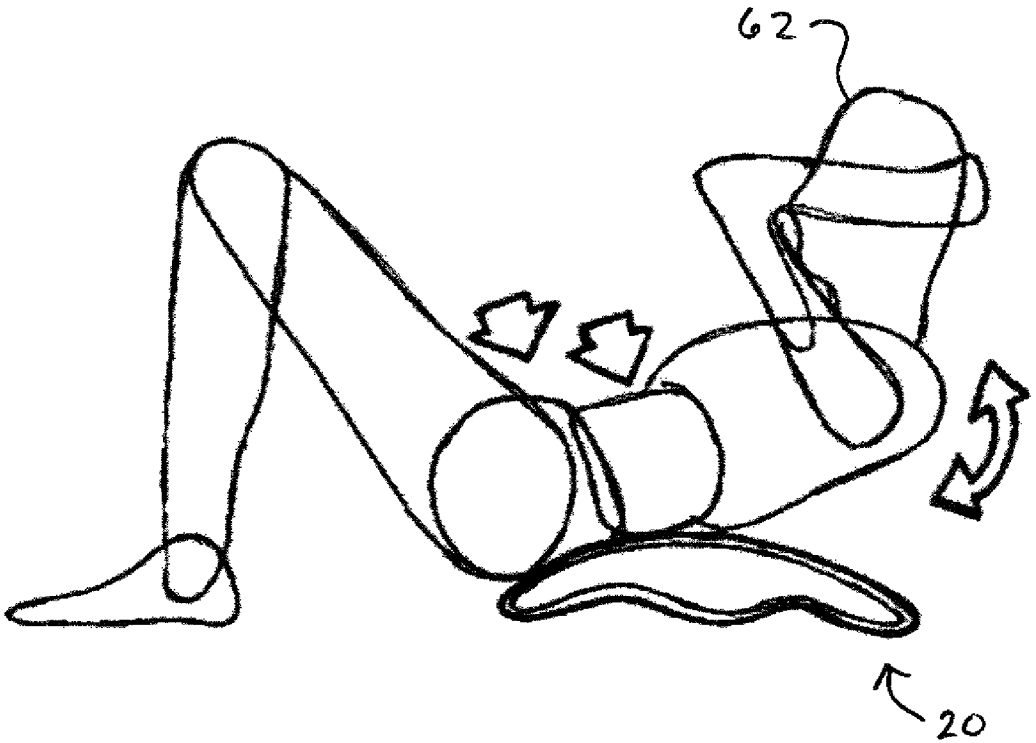
FIG. 6 shows an exerciser using the device for crunches with the invention inverted in the second configuration.
Figure 7:
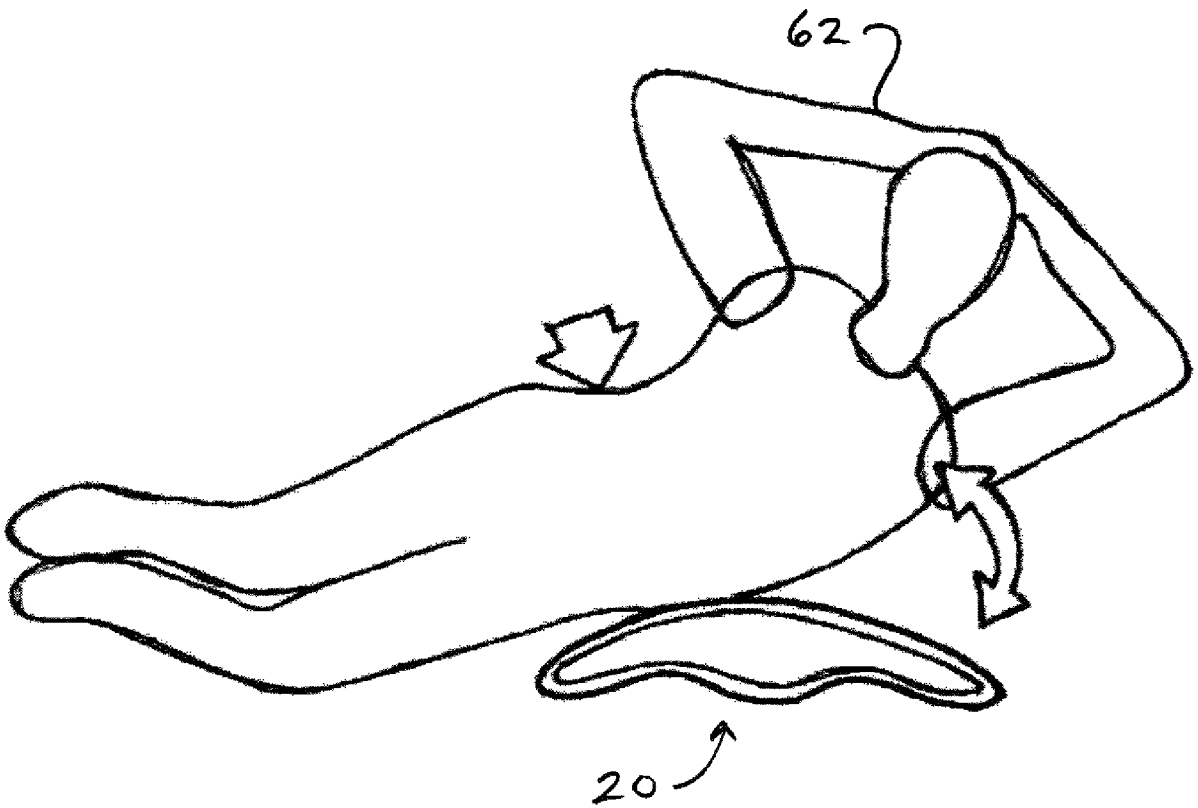
FIG. 7 shows an exerciser using the device for side crunches with the invention inverted in the second configuration.

The second configuration is shown in FIG. 6, where the exercise device 20 is inverted in a stable position and the exerciser 62 is performing a second series of crunches where hyperextension is permitted due domed bottom surface 24. The curved arrow shows the exerciser's 62 movement during the crunch exercise. In FIG. 7, the second configuration also permits a side crunch exercise. The curved arrow shows the movement of the exerciser 62 on the stable platform.

Figure 8:
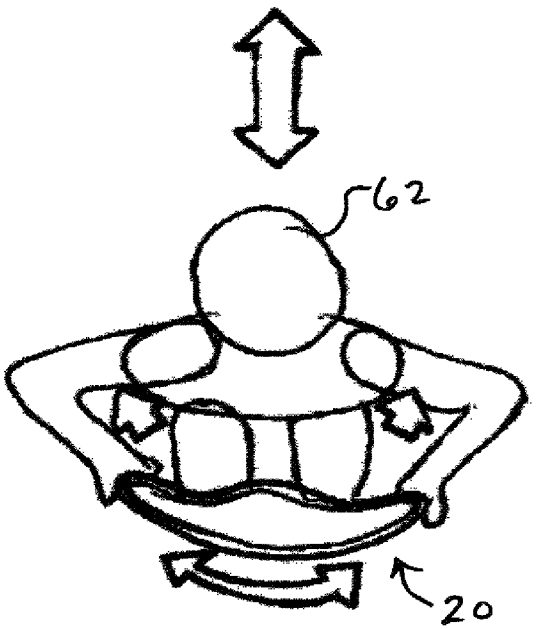
FIG. 8 shows an exerciser using the present invention for push-ups, with the invention in the first configuration.
Figure 9:
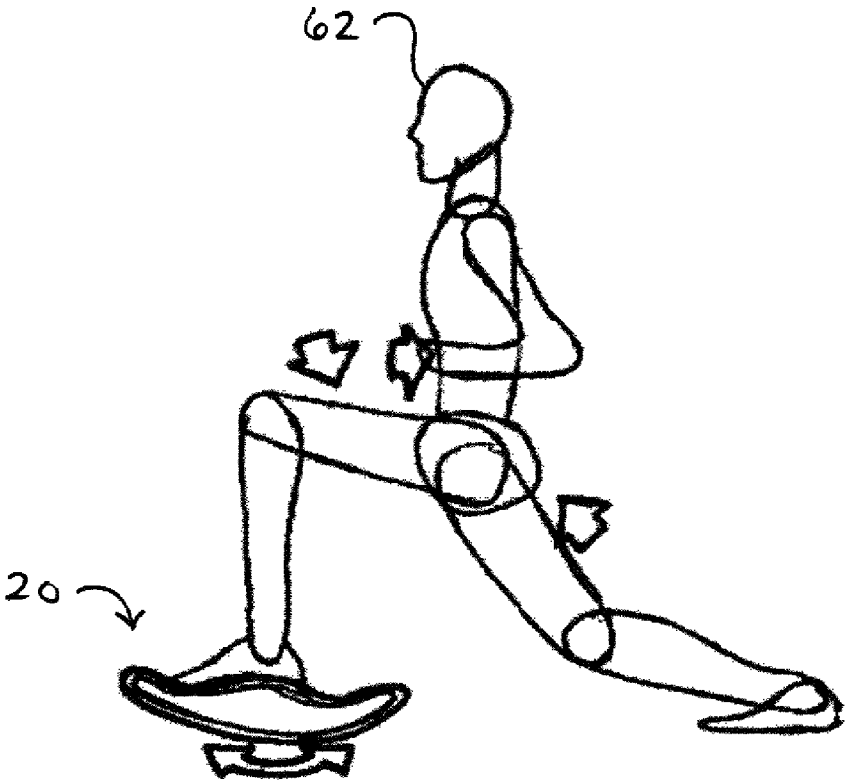
FIG. 9 shows an exerciser using the invention for lunges, with the invention in the first configuration and the arch of the foot positioned transversely across the arched ridge.

FIG. 8 illustrates an alternate exercise in the first configuration, where the exerciser 62 is grasping the contoured edges of the first end 26 and the second end 28, the legs are on the floor, and the exerciser 62 is performing a push-up exercise. Again, the instability provided by the first configuration provides an enhanced exercise regimen due to the exerciser having to provide the stability. In FIG. 9, the exerciser is performing lunges with the exercise device 20 in the first configuration. The left foot is positioned on the arched ridge 36 with the arch of the foot transversely supported across the ridge 36. The right foot is on the floor. Again, the instability provides an enhanced crunch due to the exerciser 62 having to resist tipping in all directions.

The present invention can be solid or inflatable. It could also be rigid or have some flexibility. The exercise device 20 can be injection molded using a plastic material and coated or covered with a softer material for comfort, such as neoprene rubber or the like. In an inflatable embodiment, portions of the device 20 could be made of a rigid plastic material, such as the convex dome 34, while the remainder can be made of a flexible material that comprises the inflatable shell of the device.

In addition to muscle toning, strengthening, and conditioning the present invention offers an improved sense of balance for sports that require heightened sense of balance, such as ice skating, snow skiing, gymnastics, hockey, snowboarding, water skiing, and so on. The provided instability improves the sense of balance in all directions and strengthens the muscles needed to implement the balance; and the stable platform enables more traditional exercise for pure strength training.

While particular forms of the invention have been illustrated and described, it will also be apparent to those skilled in the art that various modifications can be made without departing from the spirit and scope of the invention. Accordingly, it is not intended that the invention be limited except by the claims.

What is claimed is:

1. An exercise device comprising:

a top surface opposite a bottom surface;

a first end opposite a second end, said first end substantially parallel to said second end in at least one plane to enhance stability in a second configuration;

a first side opposite a second side;

a single convex dome on said bottom surface, such that said single convex dome is configured to provide instability in all directions when said single convex dome contacting a support surface;

an arched ridge on said top surface for supporting directly thereon a portion of an exerciser's body in at least one exercise configuration, said ridge extending from said first side to said second side, said arched ridge having an arch curvature that is substantially constant along a length of said arched ridge;

a first trough formed between said arched ridge and said first end; and a second trough formed between said arched ridge and said second end;

in a first configuration said exercise device configured to provide an unstable exercise platform when said bottom surface is positioned downward with said convex dome contacting said support surface;

in said second configuration said exercise device configured to provide a stable exercise platform when said top surface is positioned downward with both said first end and said second end contacting said support surface.

2. The exercise device of claim 1 further comprising a contour formed on each of said first end and said second end configured to be manually gripped during exercise.

3. The exercise device of claim 1 wherein in said second configuration said first end and said second end are the only portions contacting said support surface.

4. The exercise device of claim 1 wherein said portion of said exerciser's body directly supported by said arched ridge is a lower back when in said first configuration.

5. The exercise device of claim 1 wherein said portion of said exerciser's body directly supported by said arched ridge is an exerciser's foot arch when in said first configuration.

6. The exercise device of claim 1 wherein said first end and said second end are arranged such that rocking is substantially prohibited in said second configuration.

7. The exercise device of claim 1 wherein said portion of said exerciser's body is supported on and positioned substantially transverse to said length of said arched ridge.

* * * * *